US008515331B2

(12) United States Patent
Kurita

(10) Patent No.: US 8,515,331 B2
(45) Date of Patent: Aug. 20, 2013

(54) IMAGE FORMING APPARATUS AND SHEET PROCESSING APPARATUS

(75) Inventor: Hiroshi Kurita, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/589,747

(22) Filed: Aug. 20, 2012

(65) Prior Publication Data

US 2012/0315072 A1 Dec. 13, 2012

Related U.S. Application Data

(60) Division of application No. 12/833,257, filed on Jul. 9, 2010, which is a continuation of application No. 11/268,557, filed on Nov. 8, 2005, now abandoned.

(30) Foreign Application Priority Data

Jun. 20, 2005 (JP) ..... 2005-179787

(51) Int. Cl.
*G03G 15/00* (2006.01)

(52) U.S. Cl.
USPC ..... 399/405; 399/389

(58) Field of Classification Search
USPC ..... 399/405
See application file for complete search history.

(56) References Cited

U.S. PATENT DOCUMENTS

| | | | | |
|---|---|---|---|---|
| 4,135,447 | A | 1/1979 | Barnes et al. | |
| 5,296,873 | A | 3/1994 | Russell et al. | |
| 5,761,600 | A | 6/1998 | Murata | |
| 6,113,094 | A * | 9/2000 | Horiguchi et al. | 271/176 |
| 6,278,859 | B1 | 8/2001 | Nagano | |
| 6,643,476 | B1 | 11/2003 | Kinouchi et al. | |
| 6,669,189 | B2 * | 12/2003 | Seto et al. | 271/186 |
| 6,788,905 | B2 * | 9/2004 | Tsutada | 399/45 |
| 6,799,761 | B2 * | 10/2004 | Kato | 271/242 |
| 6,801,742 | B1 * | 10/2004 | Mochimaru et al. | 399/309 |
| 6,934,507 | B2 | 8/2005 | Ohki et al. | |
| 7,061,637 | B2 * | 6/2006 | Mochimaru et al. | 358/1.15 |
| 7,177,585 | B2 * | 2/2007 | Matsuzaka et al. | 399/394 |
| 2002/0007752 | A1 | 1/2002 | Sakagami | |
| 2002/0118987 | A1 | 8/2002 | Takekoshi | |
| 2004/0139857 | A1 | 7/2004 | Dichtl et al. | |

(Continued)

FOREIGN PATENT DOCUMENTS

| | | | |
|---|---|---|---|
| JP | 2542935 | Y | 4/1997 |
| JP | 11-174941 | A | 7/1999 |
| JP | 11-202738 | A | 7/1999 |
| JP | 2000-259045 | A | 9/2000 |
| JP | 2004-294651 | A | 10/2004 |
| JP | 2004-352423 | A | 12/2004 |

OTHER PUBLICATIONS

Japanese Office Action from a counterpart Japanese application, dated Jun. 29, 2010.

*Primary Examiner* — Anthony Nguyen
(74) *Attorney, Agent, or Firm* — Sughrue Mion, PLLC

(57) ABSTRACT

An image forming apparatus includes a toner image forming section that adheres toner to a sheet to form a toner image, a discharge unit into which the sheet is discharged, a conveying unit that conveys the sheet on which the toner is adhered by the toner image forming section and discharges the sheet to the discharge unit, a cooling section that cools the sheet conveyed by the conveying unit, a sheet type instructing section that instructs the type of the sheet, and a controller that controls, in accordance with the type instructed by the sheet type instructing section, the conveyance speed when the conveying unit conveys the sheet.

6 Claims, 7 Drawing Sheets

(56) References Cited

U.S. PATENT DOCUMENTS

2004/0197108 A1 10/2004 Yamagata et al.
2004/0247335 A1 12/2004 Inoue et al.
2005/0063747 A1* 3/2005 Ushio ..... 399/406

* cited by examiner

| PAPER TRAY | PAPER TYPE |
|---|---|
| TRAY 1 | ••• |
| TRAY 2 | ••• |
| ⋮ | ⋮ |

WEIGHT PER UNIT AREA

| PAPER SIZE | 60-80 gsm | 81-105 gsm | 106-135 gsm | 136-186 gsm | 187-220 gsm | 221-300 gsm | OHP |
|---|---|---|---|---|---|---|---|
| B5L | 0 | 0 | 2 | 3 | 3 | 3 | – |
| A4L | 0 | 0 | 2 | 3 | 3 | 3 | 1 |
| A4S | 0 | 0 | 2 | 3 | 3 | 3 | – |
| B4S | 0 | 0 | 0 | 0 | 3 | 3 | – |
| A3S | 0 | 0 | 0 | 0 | 3 | 3 | – |
| SRA3 (320×450) | 0 | 0 | 0 | 0 | 3 | 3 | – |
| 12"×18" (305×457) | 0 | 0 | 0 | 0 | 3 | 3 | – |
| 320×488 | 0 | 0 | 0 | 0 | 3 | 3 | – |

| PAPER SIZE \ WEIGHT PER UNIT AREA | 60-80 gsm | 81-105 gsm | 106-135 gsm | 136-186 gsm | 187-220 gsm | 221-300 gsm | OHP |
|---|---|---|---|---|---|---|---|
| B5L | 0 | 0 | INTER-MEDIATE | STRONG | STRONG | STRONG | — |
| A4L | 0 | 0 | INTER-MEDIATE | STRONG | STRONG | STRONG | WEAK |
| A4S | 0 | 0 | INTER-MEDIATE | STRONG | STRONG | STRONG | — |
| B4S | 0 | 0 | 0 | 0 | STRONG | STRONG | — |
| A3S | 0 | 0 | 0 | 0 | STRONG | STRONG | — |
| SRA3 (320×450) | 0 | 0 | 0 | 0 | STRONG | STRONG | — |
| 12"×18" (305×457) | 0 | 0 | 0 | 0 | STRONG | STRONG | — |
| 320×488 | 0 | 0 | 0 | 0 | STRONG | STRONG | — |

FIG. 10

| PAPER SIZE \ WEIGHT PER UNIT AREA | 60-80 gsm | 81-105 gsm | 106-135 gsm | 136-186 gsm | 187-220 gsm | 221-300 gsm | OHP |
|---|---|---|---|---|---|---|---|
| B5L | INTER-MEDIATE | STRONG | STRONG | STRONG | STRONG | STRONG | — |
| A4L | INTER-MEDIATE | STRONG | STRONG | STRONG | STRONG | STRONG | INTER-MEDIATE |
| A4S | WEAK | INTER-MEDIATE | STRONG | STRONG | STRONG | STRONG | — |
| B4S | WEAK | INTER-MEDIATE | STRONG | STRONG | STRONG | STRONG | — |
| A3S | WEAK | INTER-MEDIATE | STRONG | STRONG | STRONG | STRONG | — |
| SRA3 (320×450) | WEAK | INTER-MEDIATE | STRONG | STRONG | STRONG | STRONG | — |
| 12"×18" (305×457) | WEAK | INTER-MEDIATE | STRONG | STRONG | STRONG | STRONG | — |
| 320×488 | WEAK | INTER-MEDIATE | STRONG | STRONG | STRONG | STRONG | — |

IMAGE FORMING APPARATUS AND SHEET PROCESSING APPARATUS

CROSS REFERENCE TO RELATED APPLICATIONS

This application is a divisional of U.S. patent application Ser. No. 12/833,257 filed Jul. 9, 2010, which is a continuation of Ser. No. 11/268,557 filed Nov. 8, 2005, which claims priority from Japanese Patent Application No. 2005-179787 filed on Jun. 20, 2005, which applications are incorporated herein by reference in their entirety.

BACKGROUND OF THE INVENTION (1) Field of the Invention

The present invention relates to technology that cools a sheet on which a toner image is formed.

(2) Description of the Related Art

In image forming apparatus such as printers and copiers, a format is used where toner is transferred to paper (a sheet), and the toner on the paper is fused by the heat of a fixing device and thereafter cooled and caused to solidify so that the toner is fixed to the paper. In such image forming apparatus, after the toner has been fixed to the paper, the paper is discharged into a paper discharge tray while still retaining quite a bit of heat. Thus, sometimes this triggers a phenomenon called "blocking," where sheets of the discharged paper adhere to each other due to the fused toner.

In order to prevent such blocking, technology is known which uses a fan to take outside air into the conveyance path of the paper and cool the paper by sending the outside air to the conveyance path. A method is also disclosed that the paper is cooled using a cooling roller made of a heat pipe.

Incidentally, in recent years, image forming apparatus have been developed where the processing speed of the image forming process is fast. In such image forming apparatus, it becomes easier for blocking to occur because the paper discharge speed is fast. In the methods described above, there is a limit on the cooling effect; thus, in image forming apparatus where the processing speed is fast, there is the potential for paper that has not been sufficiently cooled to be discharged and for blocking to occur. And in the method described above, the paper is cooled using a cooling roller; thus, there is the potential for adverse effects to occur, such as the offset phenomenon, where some of the toner adheres to the roller and is taken away, and jamming of the paper wrapped around the roller.

SUMMARY OF THE INVENTION

The present invention has been made in view of the above circumstances and provides an image forming apparatus and a sheet processing.

According to an aspect of the present invention, an image forming apparatus includes a toner image forming section that adheres toner to a sheet to form a toner image; a discharge unit into which the sheet is discharged; a conveying unit that conveys the sheet on which the toner is adhered by the toner image forming section and discharges the sheet to the discharge unit; a cooling section that cools the sheet conveyed by the conveying unit; a sheet type instructing section that instructs the type of the sheet; and a controller that controls, in accordance with the type instructed by the sheet type instructing section, the conveyance speed when the conveying unit conveys the sheet.

BRIEF DESCRIPTION OF THE DRAWINGS

Embodiments of the invention will be described in detail based on the following figures, wherein:

FIG. 10 is a diagram showing the structure of an air volume setting table pertaining to a modified example of the invention.

DETAILED DESCRIPTION OF THE INVENTION

First Embodiment

Configuration

Figure 1:
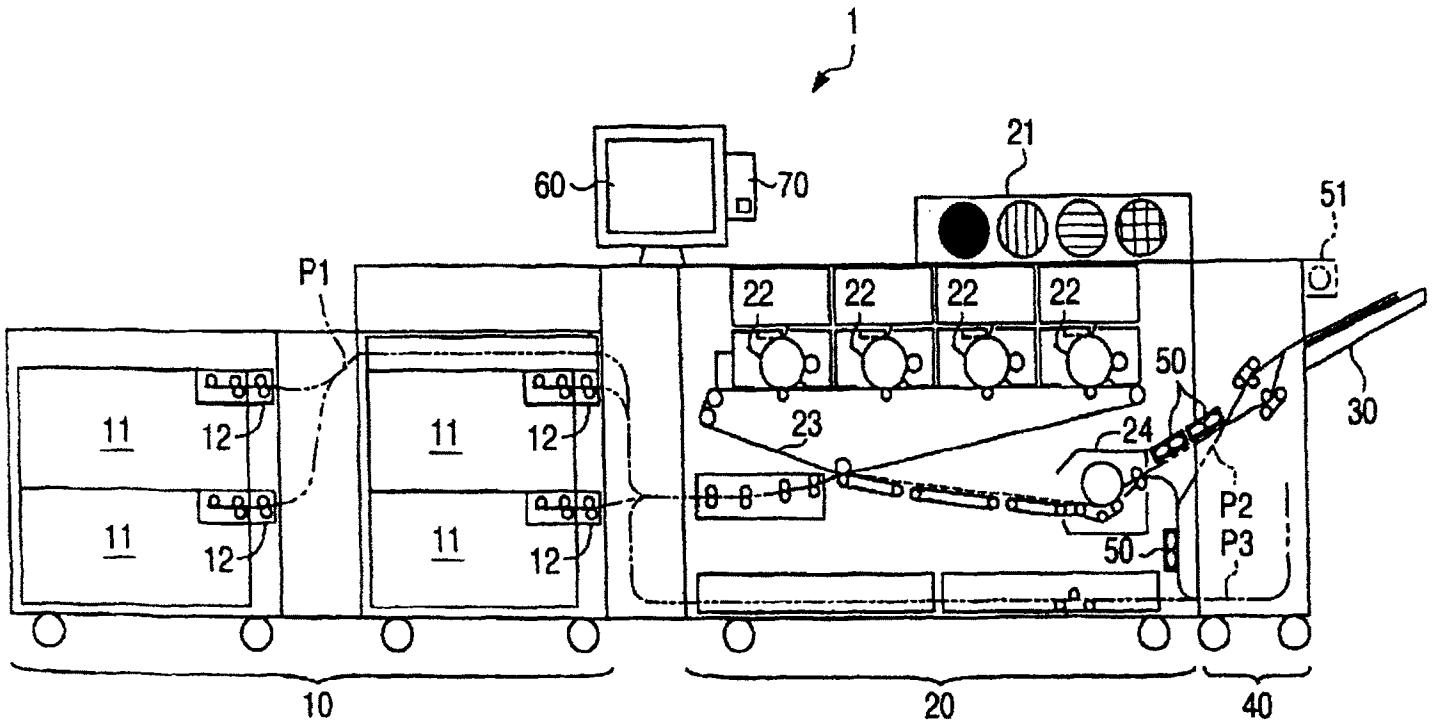
FIG. 1 is a diagram showing the overall configuration of an image forming apparatus pertaining to a first embodiment of the invention.

FIG. 1 is a diagram showing the overall configuration of an image forming apparatus 1 pertaining to a first embodiment of the invention. In FIG. 1, reference numeral 10 represents a paper supply section that supplies paper (sheets) for image formation. The paper supply section 10 includes plural paper supply trays 11, which accommodate paper for image formation, and conveyance rolls 12, which convey the paper one sheet at a time via a conveyance path P1 (represented by a dotted line in FIG. 1) from the paper supply trays 11. The image forming apparatus 1 is configured to conduct image formation with respect to different kinds of paper whose sizes are different (e.g., A4, A3) or whose materials are different (e.g., normal paper, OHP sheets), and to accommodate the different kinds of paper in the paper supply trays 11. It will be assumed here that one kind of paper is accommodated in one paper supply tray 11, and that two or more kinds of paper are not accommodated in one paper supply tray 11.

Reference numeral 20 represents a toner image forming section that forms, on the basis of image data received from another computer device or the like, a toner image on the paper supplied from the paper supply section 10. Reference numeral 21 represents a toner cartridge that houses and supplies toners of the respective colors of yellow (Y), magenta (M), cyan (C) and black (K). Reference numeral 22 represents toner image forming units that form toner images of the respective colors of Y, M, C and K with the toners of the respective colors of Y, M, C and K supplied from the toner cartridge 21. Reference numeral 23 represents an intermediate transfer belt onto which the toner images of Y, M, C and K formed by the toner image forming units 22 are transferred.

Reference numeral 24 represents a fixer that heats and pressures the paper to fix the toner to the paper. The toner image forming units 22 irradiate photosensitive drums of the respective colors of Y, M, C and K with image light, form latent images resulting from a difference in electrostatic potential on the surfaces of the photosensitive drums, visualize the latent images by selective adherence of the toner to form toner images, and transfer the toner images to the intermediate transfer belt 23. The intermediate transfer belt 23 transfers (secondarily transfers) the transferred toner images to the conveyed paper. The fixer 24 heats and pressures the paper to which the toner images is transferred from the intermediate transfer belt 23, and fixes the toner to the paper by fusing and fixing the toner.

Reference numeral 30 represents a paper discharge tray into which the paper on which the toner image is formed is discharged. Reference numeral 40 represents a paper cooling section that cools the paper to which the toner is fixed by the fixer 24. The paper cooling section 40 includes a conveyance path P2 for conveying the paper, and discharges the paper supplied from the fixer 24 into the paper discharge tray 30 via the conveyance path P2.

The paper cooling section 40 also includes a conveyance path P3 for conveying the paper. The conveyance path P3 is a conveyance path on which the paper is conveyed when toner images are tip be formed on both sides of the paper (two-sided printing). When toner images is formed on both sides of the paper, the paper cooling section 40 conveys the paper supplied from the fixer 24 to the toner image forming section 20 via the conveyance path P3. Then, the toner image forming section 20 again forms a toner image on the conveyed paper. Thus, toner images are formed on both sides of the paper, and the paper on which the toner images is formed is supplied to the paper cooling section 40 from the fixer 24. The paper cooling section 40 discharges the paper on which toner images is formed on both sides into the paper discharge tray 30 via the conveyance path P2.

Reference numeral 50 represents cooling fans for cooling the paper conveyed in the paper cooling section 40. The cooling fans 50 are disposed in the vicinity of the conveyance path P2 and the conveyance path P3 in the paper cooling section 40, and are configured to cool the paper passing along the conveyance path P2 and the conveyance path P3.

Reference numeral 60 represents a display that is configured by a liquid crystal display, for example, and displays images representing messages to the user and the operating status in accordance with a control signal from a later-described controller Reference numeral 70 represents an operation unit that is configured by a numeric keypad, a start button, a stop button, and a touch panel disposed on a liquid crystal display, and outputs signals corresponding to the operational input of the user and display screens at that time. Thus, the user can input instructions to the image forming apparatus 1 by operating the operation unit 70 while viewing the images and messages displayed on the display 60.

Next, a configuration relating to the control of the image forming apparatus 1 will be described with reference to FIG. 2.

Figures 2, 3:
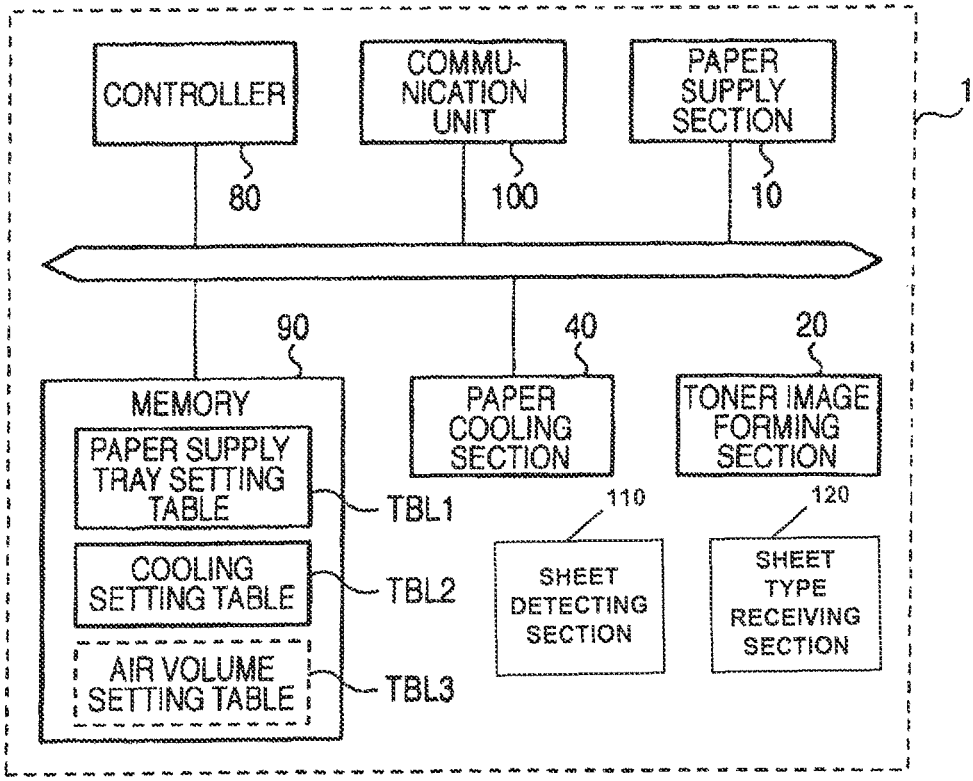
FIG. 2 is a diagram showing the configuration of hardware relating to control in the image forming apparatus pertaining to the first embodiment.
FIG. 3 is a diagram showing the structure of a paper discharge tray setting table pertaining to the first embodiment.

FIG. 2 is a block diagram schematically showing the configuration of hardware relating to the control of the image forming apparatus 1. The same reference numerals will be given to constituent elements shown in FIG. 2 that are the same as the constituent elements already described in FIG. 1, and description of those same constituent elements will be appropriately omitted.

In FIG. 2, reference numeral 80 represents the controller disposed with a processing device such as a central processing unit (CPU). Reference numeral 90 represents a memory disposed with a storage device such as a random access memory (RAM), read-only memory (ROM), or a hard disk, and stores various programs for operating the various sections of the image forming apparatus 1. The controller 80 controls the various sections of the image forming apparatus 1 via a bus by reading and executing the programs stored in the memory 90. Reference numeral 100 represents a communication unit disposed with various communication devices, and transmits data to and receives data from other devices under the control of the controller 80.

As shown in FIG. 2, a paper supply tray setting table TBL1 and a cooling setting table TBL2 are stored in the memory 90. The paper supply tray setting table TBL1 is a table that is referenced when the controller 80 of the image forming apparatus 1 selects a paper supply tray 11 corresponding to the type of paper. As shown in FIG. 3, the headings of "Paper Supply Tray" and "Paper Type" are mutually associated and stored in the paper supply tray setting table TBL1. Identification information for identifying the various paper supply trays 11 in the paper supply section 10 is stored in the "Paper Supply Tray" heading. Type information for classifying the paper, such as the size and weight per unit area of the paper, is stored in the "Paper Type" heading. The controller 80 of the image forming apparatus 1 is configured to recognize what types of paper are accommodated in which paper supply trays 11 by referencing the paper supply tray setting table TBL1.

Figures 4, 5:
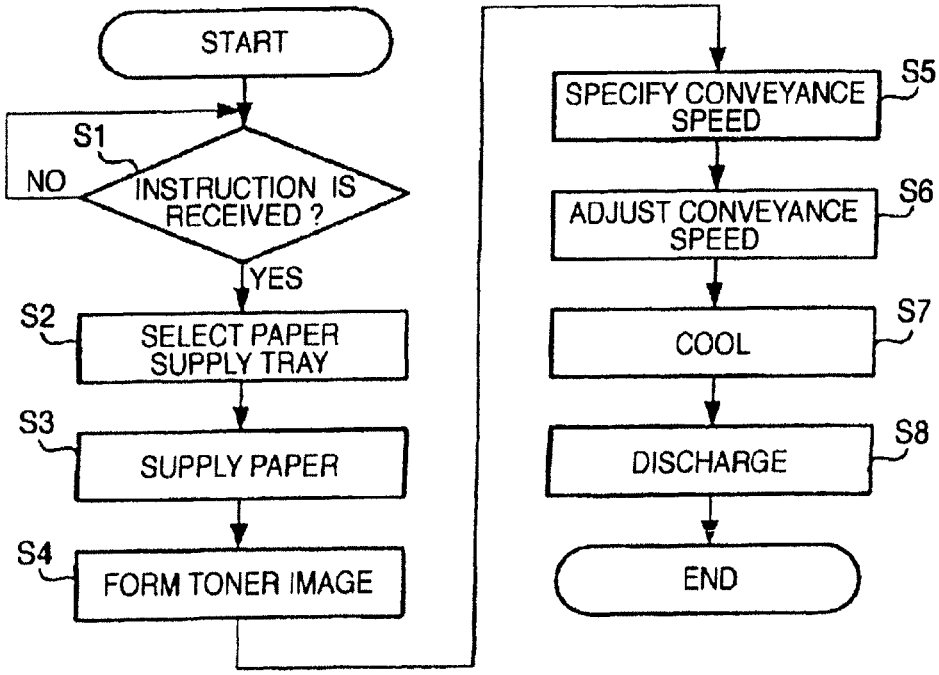
FIG. 4 is a diagram showing the structure of a cooling setting table pertaining to the first embodiment.
FIG. 5 is a flow chart showing processing pertaining to the first embodiment.

The cooling setting table TBL2 stored in the memory 90 is a table that is referenced when specifying the conveyance speed when the paper is conveyed in the paper cooling unit 40. FIG. 4 is a diagram showing an example of the data structure of this table. In the table shown in FIG. 4, information expressed by four levels of numerical values of 0 to 3 representing paper cooling conditions is arranged in a matrix and stored. The cooling condition values are values representing the ease with which blocking can occur: the larger the numeral value is, the easier it is for blocking to occur. For example, it is easier for blocking to occur with paper whose cooling condition value is large, so the cooling condition values represent that cooling is more necessary in this case. The horizontal row in the cooling setting table TBL2 is the "Weight per Unit Area," which is expressed as the unit of grams per square meter (gsm). The larger the unit weight of the paper is, the easier it becomes for blocking to occur. For example, the thicker the paper is, the more difficult it becomes for heat to be released, so it is difficult for the paper to be cooled and easy for blocking to occur. The vertical column is the "Paper Size," which is information representing the size of the paper.

The degree to which blocking can occur differs depending on the type of paper and the image processing speed per type of paper. For this reason, in the present embodiment, the controller 80 of the image forming apparatus 1 controls the conveyance speed of the paper by the paper cooling section 40 according to the type of paper, by referencing the cooling setting table TBL2. Specifically, the controller 80 specifies the conveyance speed from the four cooling condition values stored in the cooling setting table TBL2 and transmits an instruction signal to the paper cooling section 40 to convey the paper at that conveyance speed. When the paper cooling section 40 receives the instruction signal from the controller 80, it conveys the paper at the conveyance speed represented by the instruction signal.

Operation

Next, the operation of the present embodiment will be described. First, the image forming apparatus 1 receives, from another computer device or the like via the communication unit 100, an instruction (called "image formation instruction" below) to conduct image formation. Image data and type information representing the type of paper on which image formation is to be conducted are included in the image formation instruction.

FIG. 5 is a flow chart showing the processing of the image forming apparatus 1. When the controller 80 of the image forming apparatus 1 detects that the image formation instruction is received (step S1: YES), it first searches the paper supply tray setting table TBL1 stored in the memory 90 for the paper type information included in the received image formation instruction, and selects the paper supply tray 11 corresponding to the searched-for paper type (step S2). The paper supply section 10 supplies the paper to the toner image forming section 20 from the paper supply tray 11 selected in step S2 under the control of the controller 80 (step S3). When the paper is supplied to the toner image forming section 20, the toner image forming section 20 forms toner images on the supplied paper under the control of the controller 80 (step S4). The toner images are formed on the paper by the above processing.

Next, the controller 80 of the image forming apparatus 1 references the cooling setting table TBL2 stored in the memory 90, reads the cooling setting value corresponding to the received paper type information, and specifies the conveyance speed of the paper in the paper cooling section 40 (step S5). Then, the controller 80 adjusts the conveyance speed by transmitting a control signal to the paper cooling section 40 to convey the paper at the specified conveyance speed (step S6). For example, in the example of the table shown in FIG. 4, if the size of the paper is "B5L" and the weight per unit area of the paper is "150 gsm," then the controller 80 adjusts the conveyance speed to the fastest speed of the four levels.

The paper cooling section 40 conveys, under the control of the controller 80, the paper via the conveyance path P2 (or the conveyance path P2 and the conveyance path P3 in the case of two-sided printing) at the conveyance speed instructed by the controller 80, and cools the paper conveyed on the conveyance path P2 (or the conveyance path P3) with the cooling fans 50 (step S7). Then, the paper cooling section 40 discharges the cooled paper to the paper discharge tray 30 (step S8).

As described above, in the present embodiment, the conveyance speed when the paper is conveyed in the paper cooling section 40 is controlled according to the type of paper. In other words, in the case of paper with which blocking occurs easily, the conveyance of the paper in the paper cooling unit 40 is executed at a low speed and the paper is kept in the cooling area for a long time to prevent blocking. By configuring the invention in this manner, paper on which a toner image is formed can be excellently cooled and blocking can be prevented, even in an image forming apparatus where the processing speed of the image forming process is fast and where the paper discharge speed is fast.

Also, when the conveyance speed is made slow with respect to all paper, there is the problem that the paper discharge speed becomes slow and the productivity of the image forming apparatus becomes low. However, in the present embodiment, the conveyance speed is controlled in accordance with the type of paper; thus, for example, control can be conducted with respect to paper for which cooling is not really necessary, such as maximizing the conveyance speed, and the productivity of image formation can be prevented from being lowered.

Second Embodiment

Next, a second embodiment of the invention will be described.

The present embodiment is different from the first embodiment in that the operation of the controller and the paper cooling section of the image forming apparatus is different. The overall configuration of the image forming apparatus of the present embodiment is the same as that of the first embodiment. For this reason, in the following description, the same reference numerals will be used for constituent elements that are the same as those of the first embodiment, and description of those constituent elements will be omitted.

The operation of the present embodiment will be described with reference to the flow chart shown in FIG. 6. Because the general flow of the processing of the image forming apparatus 1 in the present embodiment is the same as that of the processing described in FIG. 5 of the image forming apparatus in the first embodiment, in the following description, the same reference numerals will be given to processing that is the same as the processing shown in FIG. 5, description thereof will be omitted, and the processing that is different from that of the first embodiment will be mainly described.

In the first embodiment, the controller 80 of the image forming apparatus 1 was configured to reference the cooling condition values stored in the cooling setting table TBL2 stored in the memory 90, specify the conveyance speed, and conduct control such that the paper was conveyed at the specified conveyance speed. In contrast, in the present embodiment, the controller 80 of the image forming apparatus 1 references the cooling condition values stored in the cooling setting table TBL2, specifies the conveyance path (step S5') and conducts control such that the paper is conveyed on the specified conveyance path in the paper cooling section 40 (step S6').

Figures 6, 7:
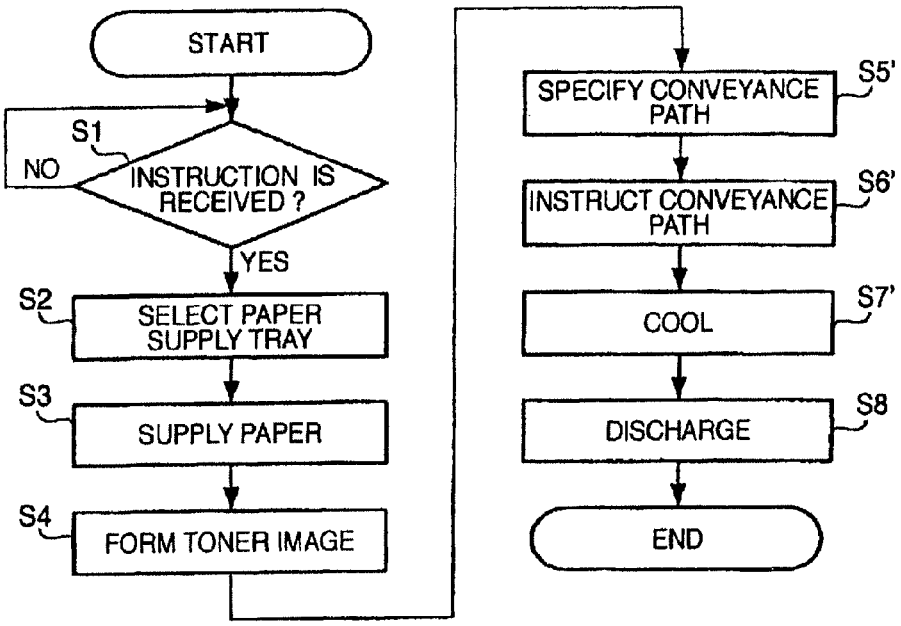
FIG. 6 is a flow chart showing processing of an image forming apparatus pertaining to a second embodiment of the invention.
FIG. 7 is a diagram showing the structure of an air volume setting table pertaining to a third embodiment of the invention.

In FIG. 6, when the toner images are formed on the paper by the toner image forming section 20 (step S4), the controller 80 of the image forming apparatus 1 specifies the conveyance path of the paper in the paper cooling section 40 by referencing the cooling condition values stored in the cooling setting table TBL2 (step S5').

For example, if the paper size is "B5L" and the weight per unit area of the paper is "150 gsm," then the controller specifies the conveyance path by reading the cooling condition value "3" corresponding to the "B5L" row and the "150 gsm" column. In this case, the controller 80 instructs the conveyance path by transmitting to the paper cooling section 40 a control signal for the conveyance path to be the longest because the paper is of a type for which cooling is most necessary (step S6°). The paper cooling section 40 conveys, under the control of the controller 80, the paper via the conveyance path instructed by the controller 80 and cools the conveyed paper with the cooling fans 50 (step S7').

The longer the conveyance path is, the longer the cooling time becomes, because the conveyance time becomes longer. For this reason, in the present embodiment, when conveying paper with which blocking easily occurs, i.e., paper whose cooling condition value is high, the conveyance path is lengthened by conveying the paper on part of the conveyance path P3 and then conveying the paper on the conveyance path P2, for example. Conversely, when conveying paper with which blocking difficulty occurs, i.e., paper whose cooling condition value is small, the paper is discharged to the paper discharge tray 30 via the shortest conveyance path (the conveyance path P2 shown in FIG. 1).

By configuring the invention in this manner, the cooling time can be lengthened and blocking can be prevented in the case of paper with which blocking easily occurs. Conversely, in the case of paper with which blocking difficultly occurs, the paper can be conveyed on the shortest conveyance path, and the processing speed can be prevented from being lowered, the productivity of the image forming apparatus 1 can be prevented from being lowered.

As described above, in the present embodiment, the conveyance path when the paper is conveyed in the paper cooling section 40 is controlled according to the type of paper. By configuring the invention in this manner, paper on which a toner image is formed can be excellently cooled and blocking can be prevented, even in an image forming apparatus where the processing speed of the image forming process is fast and where the paper discharge speed is fast.

Also, when the conveyance path is made long with respect to all paper, there is the problem that the paper discharge speed becomes slow and the productivity of the image forming apparatus becomes low. However, in the present embodiment, the conveyance path is controlled in accordance with the type of paper; thus, for example, control can be conducted with respect to paper for which cooling is not really necessary, such as minimizing the conveyance path, and the productivity of image formation can be prevented from being lowered.

Third Embodiment

Next, a third embodiment of the invention will be described. The configuration of the image forming apparatus of the present embodiment is different from that of the image forming apparatus of the first embodiment in that a cooling fan 51 (represented by a dotted line in FIG. 1) for cooling the paper discharged to the paper discharge tray 30 is disposed in the vicinity of the paper discharge tray 30, and in that an air volume setting table TBL3 (represented by a dotted line in FIG. 2) is stored in the memory 90 instead of the cooling setting table TBL2. The other constituent elements are the same as those of the first embodiment.

FIG. 7 is a diagram showing an example of the data structure of the air volume setting table TWA. This table is a table that is referenced when the controller 80 of the image forming apparatus 1 specifies the air volumes of the cooling fans 50 and the cooling fan 51. Information representing air volumes ("0," "weak," "intermediate," and "strong") are arranged in a matrix and stored in the air volume setting table TBL3. Because the elements in the horizontal rows and vertical columns in the air volume setting table TBL3 are the same as those in the cooling setting table TBL2 in the first embodiment, description thereof will be omitted here. The controller 80 of the image forming apparatus 1 controls the air volumes of the cooling fans 50 and the cooling fan 51 by referencing this table.

Figure 8:
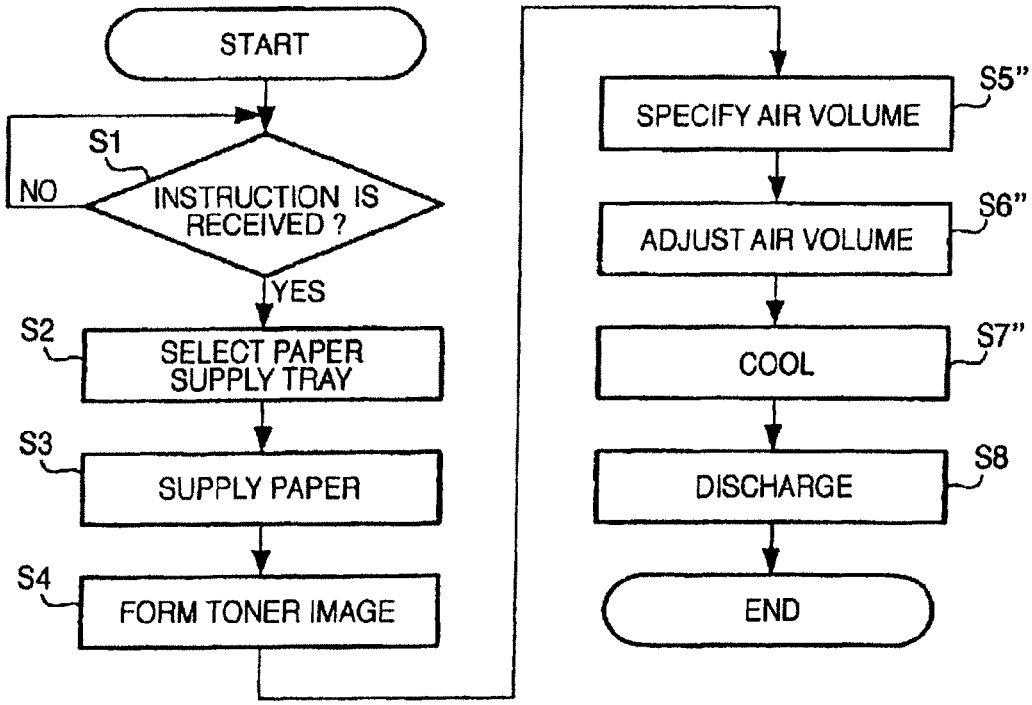
FIG. 8 is a flow chart showing processing of an image forming apparatus pertaining to the third embodiment.

Next, the operation of the present embodiment will be described with reference to the flow chart shown in FIG. 8. Because the general flow of the processing of the image forming apparatus 1 in the present embodiment is the same as that of the processing described in FIG. 5 of the image forming apparatus 1 in the first embodiment, in the following description, the same reference numerals will be given to processing that is the same as the processing shown in FIG. 5, description thereof will be omitted, and the processing that is different from that of the first embodiment will be mainly described.

In the first embodiment, the controller 80 of the image forming apparatus 1 was configured to reference the setting values stored in the cooling setting table TBL2 stored in the memory 90, specify the conveyance speed, and conduct control such that the paper was conveyed at the specified conveyance speed in the paper cooling section 40. In contrast, in the present embodiment, the controller 80 of the image forming apparatus 1 references the setting values stored in the air volume setting table TBL3 stored in the memory 90, specifies the air volume (step S5"), and adjusts the air volume by transmitting a control signal to the cooling fans 50 and the cooling fan 51 (step S6"). The cooling fans 50 and the cooling fan 51 conduct cooling at the specified air volume under the control of the controller 80 (step S7").

As described above, in the present embodiment, the air volume of the cooling fans 50 and the cooling fan 51 is controlled in accordance with the type of paper. By configuring the invention in this manner, paper on which a toner image is formed can be excellently cooled and blocking can be prevented, even, in an image forming apparatus where the paper discharge speed is fast.

Also, when the air volume of the cooling fans 50 or the cooling fan 51 is increased with respect to all paper, there is the problem that this results in jamming depending on the paper. However, in the present embodiment, the air volume is controlled in accordance with the type of paper; thus, for example, control can be conducted with respect to paper for which cooling is not really necessary, such as reducing the air volume, and jamming can be prevented from occurring.

Modified Examples

An embodiment of the invention has been described above, but the present invention is not limited to the preceding embodiments and can be implemented in various other ways. Examples of such modifications will be described below.

(1) In the third embodiment, the cooling fan 51 was disposed in the vicinity of the paper discharge tray 30 of the image forming apparatus 1. However, a cooling fan may be disposed in a sheet processing apparatus that sequentially receives the paper discharged from the image forming apparatus and conducts post-processing, so that the paper is cooled without disposing a cooling fan in the image forming apparatus itself. An example thereof will be described below.

Figure 9:
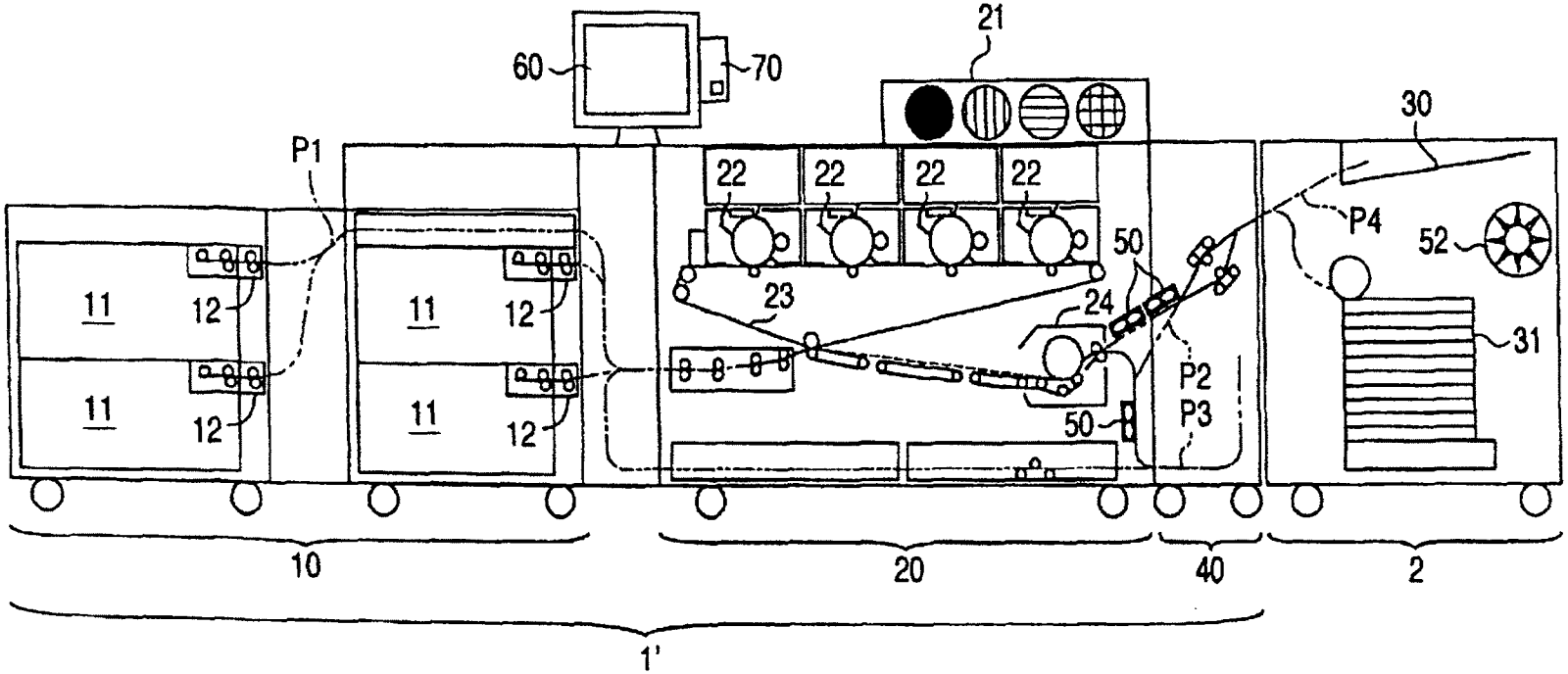
FIG. 9 is a diagram showing the overall configuration of an image forming system pertaining to a modified example of the invention.

FIG. 9 is a diagram showing an example of the overall configuration of an image forming system 3 pertaining to the present modified example. The image forming system 3 of the present modified example is configured by an image forming apparatus 1' and a sheet processing apparatus 2. The image forming apparatus 1' of the present modified example is different from the image forming apparatus 1 of the third embodiment in that it does not include a paper discharge unit into which the paper is discharged. The other constituent elements are the same as those of the image forming apparatus 1 of the third embodiment.

The sheet processing apparatus 2 is a sheet processing apparatus that sequentially receives the paper discharged from the image forming apparatus 1' and conducts various post-processing deemed necessary by the user, such as bundled discharge and binding, for example. In FIG. 9, reference numeral 30 represents a paper discharge tray. When post-processing is not to be conducted (when post-processing is not instructed), the sheet processing apparatus 2 discharges the paper received from the image forming apparatus 1' into the paper discharge tray 30 via a conveyance path P4 Reference numeral 31 represents a tray unit that includes an intermediate tray for conducting post-processing such as bundled discharge and binding and a stacking tray that accommodates, per bundle, a bundle of paper for which post-processing is conducted. Reference numeral 52 represents a cooling fan that cools the sheet processing apparatus 2.

FIG. 10 is a diagram showing the data structure of an air volume setting table stored in a memory of the sheet processing apparatus 2. Although the cooling condition information that is set is different, the structure of this table is the same as that shown in FIG. 7 in the third embodiment. The sheet processing apparatus 2 in the present modified example conducts air blowing by adjusting the air volume of the cooling fan 52 in accordance with the content of the air volume setting table. For example, the sheet processing apparatus 2 may be configured to receive a control signal representing the type of paper from the image forming apparatus 1', and when the sheet processing apparatus 2 receives that control signal, it may specify the type of paper based on the received control signal, specify the air volume of the cooling fan 52 on the basis of the type and the air volume setting table, and control the cooling fan 52 to conduct cooling at the specified air volume. By configuring the invention in this manner, paper on which a toner image is formed can be excellently cooled and blocking can be prevented, even in an image forming apparatus where the paper discharge speed is fast.

(2) In the preceding embodiment, the controller 80 of the image forming apparatus 1 was configured to receive, from another computer device or the like, an image formation instruction including type information representing the type of paper and specify the type of paper from the received type information. However, the method of specifying the type of paper is not limited to this. For example, the method may be configured such that the user operates an operation unit in the image forming apparatus to input the paper type information, so that the type of paper is specified from the inputted type information. Alternatively, the method may be configured such that the user operates an operation unit in the image forming apparatus to select the paper supply tray, so that the type of paper is specified in accordance with the selected paper supply tray. In this case, the invention may be configured such that the type of paper is specified by referencing the paper supply tray setting table TBL1 stored in the memory 90 of the preceding embodiment and read the type of paper corresponding to the selected paper supply tray.

The invention may also be configured such that detecting section such as a sensor that detects the type of paper and outputs information representing the detected content is disposed in a paper supply tray or the conveyance path of the paper, and such that the controller of the image forming apparatus specifies the type of paper in accordance with the information outputted from the detecting section. The sensor in this case may be one that includes plural optical sensors which detect the width-direction size of the paper and output this as the type of paper, or may be one that includes plural pressure sensors that detect the weight per unit area of the paper and output this as the type of paper. Or, the sensor may be one that includes an ultrasonic sensor that detects the thickness of the paper and outputs this as the type of paper. In addition, the invention may be configured to include a sensor that detects the physical characteristics of the paper, so that the type of paper is detected from the physical characteristics detected by the sensor.

As described above, some embodiments of the invention are outlined below.

According to an aspect of the present invention, an image forming apparatus includes a toner image forming section that adheres toner to a sheet to form a toner image; a discharge unit into which the sheet is discharged; a conveying unit that conveys the sheet on which the toner is adhered by the toner image forming section and discharges the sheet to the discharge unit; a cooling section that cools the sheet conveyed by the conveying unit; a sheet type instructing section that instructs the type of the sheet; and a controller that controls, in accordance with the type instructed by the sheet type instructing section, the conveyance speed when the conveying unit conveys the sheet.

According to another aspect of the present invention, an image forming apparatus includes: a toner image forming section that adheres toner to a sheet to form a toner image; a discharge unit into which the sheet is discharged; a conveying unit that includes at least two conveyance paths whose conveyance distances are different, conveys, via one of the conveyance paths, the sheet on which the toner is adhered by the toner image forming section, and discharges the sheet to the discharge unit; a cooling section that cools the sheet conveyed by the conveying unit; a sheet type instructing section that instructs the type of the sheet; and a controller that controls, in accordance with the type instructed by the sheet type instructing section, the conveyance path through which the sheet is conveyed by the conveying.

According to another aspect of the present invention, an image forming apparatus includes a toner image forming section that adheres toner to a sheet to form a toner image; a discharge unit into which the sheet is discharged; a conveying unit that conveys the sheet on which the toner is adhered by the toner image forming section and discharges the sheet to the discharge unit; a cooling section that cools, by blowing air, the sheet on which the toner is fixed by the toner image forming section; a sheet type instructing section that instructs the type of the sheet; and a controller that controls, in accordance with the type instructed by the sheet type instructing section, the air volume in which the cooling section blows to cool the sheet.

In another aspect of the invention, the cooling section may be configured to cool the sheet by blowing air onto the sheet conveyed by the conveying unit.

In another aspect of the invention, the cooling section may be configured to cool the sheet by blowing air onto the discharge unit itself or the sheet discharged into the discharge unit.

In yet another aspect of the invention, the image forming apparatus may further include plural sheet accommodating units that accommodate plural types of the sheet per type; a memory that stores corresponding relationships between the sheet accommodating units and the types of the sheet; a sheet supplying section that supplies, to the toner image forming section, the sheet accommodated in the sheet accommodating units; and a selecting section with which any of the sheet accommodating units is selected, wherein the sheet type instructing section references the corresponding relationships stored in the memory, specifies the type of the sheet corresponding to the sheet accommodating unit selected by the selecting section, and instructs the specified type.

In another aspect of the invention, the image forming apparatus may further include a sheet detecting section that detects the type of the sheet and outputs information representing the detected type, wherein the sheet type instructing section specifies the type of the sheet from the information outputted from the detecting section and instructs the specified type.

According to another aspect of the present invention, a sheet processing apparatus that sequentially receives sheets discharged from an image forming apparatus and conducts post-processing, includes a cooling section that cools the sheet by blowing air; a sheet type instructing section that instructs the type of the sheet; and a controller that controls, in accordance with the type of the sheet instructed by the sheet type instructing section, the air volume in which the cooling section blows to cool the sheet.

The image forming apparatus or the sheet processing apparatus may further include a sheet type receiving section to which type information representing the type of the sheet is inputted, wherein the sheet type instructing section specifies the type of the sheet according to the type information inputted to the sheet type receiving section and instructs the specified type.

In the image forming apparatus or the sheet processing apparatus, the type of the sheet may be distinguished by at least any one of the size of the sheet and the weight per unit area of the sheet.

According to an aspect of the present invention, paper on which a toner image has been formed may be excellently cooled and blocking may be prevented, even in an image forming apparatus where the processing speed of the image forming process is fast and where the paper discharge speed is fast.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

The entire disclosure of Japanese Patent Application No. 2005-179787 filed on Jun. 20, 2005 including specification, claims, drawings and abstract is incorporated herein by reference in its entirety.

What is claimed is:

1. An image forming apparatus comprising:

a toner image forming section that adheres toner to a sheet to form one or more toner images on one or both sides of the sheet;

a discharge unit into which the sheet, on which the one or more toner images are formed on the one or both sides, is discharged;

a sheet type instructing section that specifies a type of the sheet;

a controller that (i) determines, based on whether the one or more toner images are formed on the one or both sides of the sheet, whether the sheet is ready to be discharged to the discharge unit, and (ii) outputs an instruction, in response to determining that the sheet is ready to be discharged to the discharge unit and based on the type of the sheet specified by the sheet type instructing section, identifying a first conveyance path or a second conveyance path for conveying the sheet to the discharge unit and for cooling the sheet while conveying the sheet to the discharge unit; and a conveying unit that conveys the sheet, on which the one or more toner images are formed on the one or both sides of the sheet, on the first conveyance path or on the second conveyance path for cooling the sheet in response to the instruction output by the controller, and discharges the sheet conveyed on the first conveyance path or the second conveyance path to the discharge unit.

2. The image forming apparatus of claim 1, wherein the second conveyance path includes the first conveyance path and an additional conveyance path for conveying the sheet to the discharge unit.

3. The image forming apparatus of claim 1, wherein the controller identifies the first conveyance path or the second conveyance path based on a size of the sheet.

4. The image forming apparatus of claim 1, wherein the controller identifies the first conveyance path or the second conveyance path based on a cooling condition for the type of the sheet, wherein the cooling condition is set based on a size of the sheet and a weight per unit area of the sheet.

5. The image forming apparatus of claim 1, wherein the first conveyance path is shorter than the second conveyance path.

6. An image forming apparatus comprising:

a toner image forming section that adheres toner to a sheet to form one or more toner images on one or both sides of the sheet;

a discharge unit into which the sheet, on which the one or more toner images are formed on the one or both sides, is discharged;

a sheet type instructing section that specifies a type of the sheet;

a controller that (i) determines, based on whether the one or more toner images are formed on the one or both sides of the sheet, whether the sheet is ready to be discharged to the discharge unit, (ii) identifies, in response to determining that the sheet is ready to be discharged to the discharge unit and based on the type of the sheet specified by the sheet type instructing section, a first conveyance path or a second conveyance path for conveying the sheet to the discharge unit and for cooling the sheet while conveying the sheet to the discharge unit, (iii) generates an instruction based on the identified first conveyance path or the second conveyance path, and (iv) outputs the instruction identifying the first conveyance path or the second conveyance path; and a conveying unit that conveys the sheet, on which the one or more toner images are formed on the one or both sides of the sheet, on the first conveyance path or on the second conveyance path for cooling the sheet in response to the instruction output by the controller, and discharges the sheet conveyed on the first conveyance path or the second conveyance path to the discharge unit, wherein the second conveyance path includes the first conveyance path and an additional conveyance path for conveying the sheet to the discharge unit, wherein the additional path is used when toner images are formed on both sides of the sheet.

* * * * *